United States Patent [19]

Olson

[11] Patent Number: 4,909,503

[45] Date of Patent: Mar. 20, 1990

[54] APPARATUS FOR TRAINING SKIERS

[76] Inventor: Bruce R. Olson, 458 S. Clovis Ave., #105, Fresno, Calif. 93727

[21] Appl. No.: 266,146

[22] Filed: Nov. 2, 1988

Related U.S. Application Data

[63] Continuation-in-part of Ser. No. 112,620, Oct. 26, 1987, Pat. No. 4,802,856.

[51] Int. Cl.[4] ..... A63B 69/18

[52] U.S. Cl. ..... 272/97; 434/253

[58] Field of Search ..... 272/97, 70, DIG. 4; 434/253

[56] References Cited

U.S. PATENT DOCUMENTS

| | | | |
|---|---|---|---|
| 3,591,172 | 7/1971 | Hade | 272/97 |
| 3,708,163 | 1/1973 | Hunes | 272/97 |
| 3,874,656 | 4/1975 | Wintersteller | 272/97 |
| 4,802,856 | 2/1989 | Olson | 272/97 |

*Primary Examiner*—Stephen R. Crow

*Attorney, Agent, or Firm*—Worrel & Worrel

[57] ABSTRACT

Apparatus for training skiers the apparatus including a frame mounting a pair of resilient cords which interconnect the frame and the tails of the individual skis for supporting the tails of skis in elevated relation, and pivot assemblies mounted on the tips of the skis and rested on a supporting surface and operable to allow a skier wearing the skis to swing the skis and pivot the skis about their respective longitudinal axes for purposes of simulating various ski maneuvers.

15 Claims, 5 Drawing Sheets

APPARATUS FOR TRAINING SKIERS

This application is a continuation in part of application Ser. No. 07/112,620, filed on Oct. 26, 1987, now U.S. Pat. No. 4,802,856.

BACKGROUND OF THE INVENTION

1. Field of the Invention:

The present invention relates to an apparatus for training skiers for downhill skiing and more particularly to such an apparatus which is operable to mount a pair of skis in spaced angulated rested relation on the surface of the earth, the apparatus operable to allow independent movement of the skis about their respective longitudinal axes for the purpose of permitting the skier to simulate various ski turns and thereby helping the skier to develop the correct sense of timing through repetition of the various body positions and ski shifts necessary to perform same.

2. Description of the Prior Art:

Among the outdoor sports most enjoyed in winter, snow skiing is the sport most popular with winter enthusiasts. With the advent of improved instruction techniques and the development of new, lighter, and improved equipment, this arduous sport, once the province of only quite athletic individuals, is now enjoyed by people of all levels of athletic ability.

The inability of a skier to control his skis in various situations can lead to spills and possible serious injury. Manufacturers of skis have approached the various problems associated with ski control by directing a great deal of research activity toward improving the materials utilized in the manufacture of these skis. Such activities have been directed to, for example, manufacturing skis that have "soft tips" and "hard tails" or conversely "hard tips" and "soft tails" to give the ski varied performance characteristics in diverse snow conditions. In addition, the skis have been manufactured with various edge configurations which are better able to engage the snow surface and give the manifestation of enhanced control.

Although there have been significant advances in producing skis for recreational and competitive use which give the individual skier improved control, skiers of all levels of ability have sought after an apparatus which would permit them further to refine or otherwise develop an improved skiing technique. It should be understood that skiing is a sport which requires a developed sense of timing, balance, and rhythm, especially to perform the expert short swing parallel turns associated with an accomplished recreational skier. To develop this sense of balance and timing, the skier must coordinate assorted muscle groups which perform the weighting of the uphill and downhill skis; the performance of ski edging; pole planting; and the absorption of shock from terrain changes which the skier is traveling over.

Although there have been significant advances in producing training devices for recreational and competitive skiers which gives the individual skier a means by which they can improve their skiing technique in the off season, the improvements in these devices have been only marginally satisfactory. For example, many of the prior art devices do not permit the rotation of the skis about their respective longitudinal axes. This is an important feature inasmuch as this motion is necessary to permit the effective edging of the skis. Furthermore, the prior art devices generally do not permit skiers to utilize their own equipment thereby permitting the skiers to become familiar with the use and "feel" of their equipment.

Another common shortcoming in the prior art devices stems from characteristics inherent in their design inasmuch as the prior art devices are generally incapable of accurately reproducing an actual ski turn thereby permitting the skier to improve their ski technique by allowing the skier to develop the correct sense of timing, balance and rhythm with respect to the turn in question. As a consequence, skiers of all levels of ability have continued to seek after an apparatus for training downhill skiing which permits the skier to pattern actual ski turns with accuracy sufficient to allow the user thereof to improve his actual ski technique and thereby selectively choose the speed and control which he wishes to maintain whether the speed is relatively low or of competitive caliber.

Therefore, it has long been known that it would be desirable to have an improved apparatus for training skiers which is particularly well suited to allow the skier accurately to pattern and coordinate the body positions and ski shifts necessary to perform assorted ski turns in a repetitive and highly accurate fashion, which is relatively inexpensive to manufacture and maintain, and which is characterized by ease of utilization.

SUMMARY OF THE INVENTION

Therefore, it is an object of the present invention to provide an improved apparatus for training skiers.

Another object is to provide such an apparatus which can be utilized by skiers of all levels of abilities.

Another object is to provide such an apparatus which permits the skier cyclically to swing and rotate a pair of skis independently about their respective longitudinal axes thereby simulating the basic actions of unweighting and edging the individual skis which is necessary for most types of ski turns.

Another object is to provide such an apparatus which permits the repetition of simulated ski turns utilizing the skier's own equipment, the apparatus helping the skier to develop the correct sense of timing, rhythm, and balance through repetition, of the various body movements and ski shifts necessary to accomplish same.

Another object is to provide such an apparatus which produces a natural frequency of motion in the ski tails which approximates the rate of turning necessary to maintain effective control on an advanced to intermediate ski slope.

Another object is to provide such an apparatus wherein the skier utilizing same employs the muscle groups which are primarily involved in skiing, and the physical exertion necessary to utilize the apparatus improves the skier's overall aerobic conditioning.

Another object is to provide such an apparatus which is particularly well suited for training a skier to make precise turns and otherwise have effective control over a wide variety of snow conditions and snow topography.

Another object is to provide such an apparatus which is characterized by simplicity of design, ease of employment and which can be manufactured and sold at a relatively nominal cost.

Further objects and advantages are to provide improved elements and arrangements thereof in an apparatus for the purposes described which is dependable, economical, durable and fully effective in accomplishing its intended purposes.

These and other objects and advantages are achieved in an apparatus for training skiers, the apparatus having a frame resting on the surface of the earth and mounting an adjustment assembly for positioning the rearward portions of a pair of operational skis in angulated, spaced, rested relation relative to the surface of the earth while the skier is wearing the skis, and a pair of resilient cords individually connect the rearward portion of each ski with the frame for supporting the rearward portion of each ski in spaced relation to the surface of the earth, the apparatus permitting the skier cyclically to swing and rotate each ski about its respective longitudinal axis for the purpose of emulating various ski turns.

DESCRIPTION OF THE PREFERRED EMBODIMENT

First Form

Figure 1:
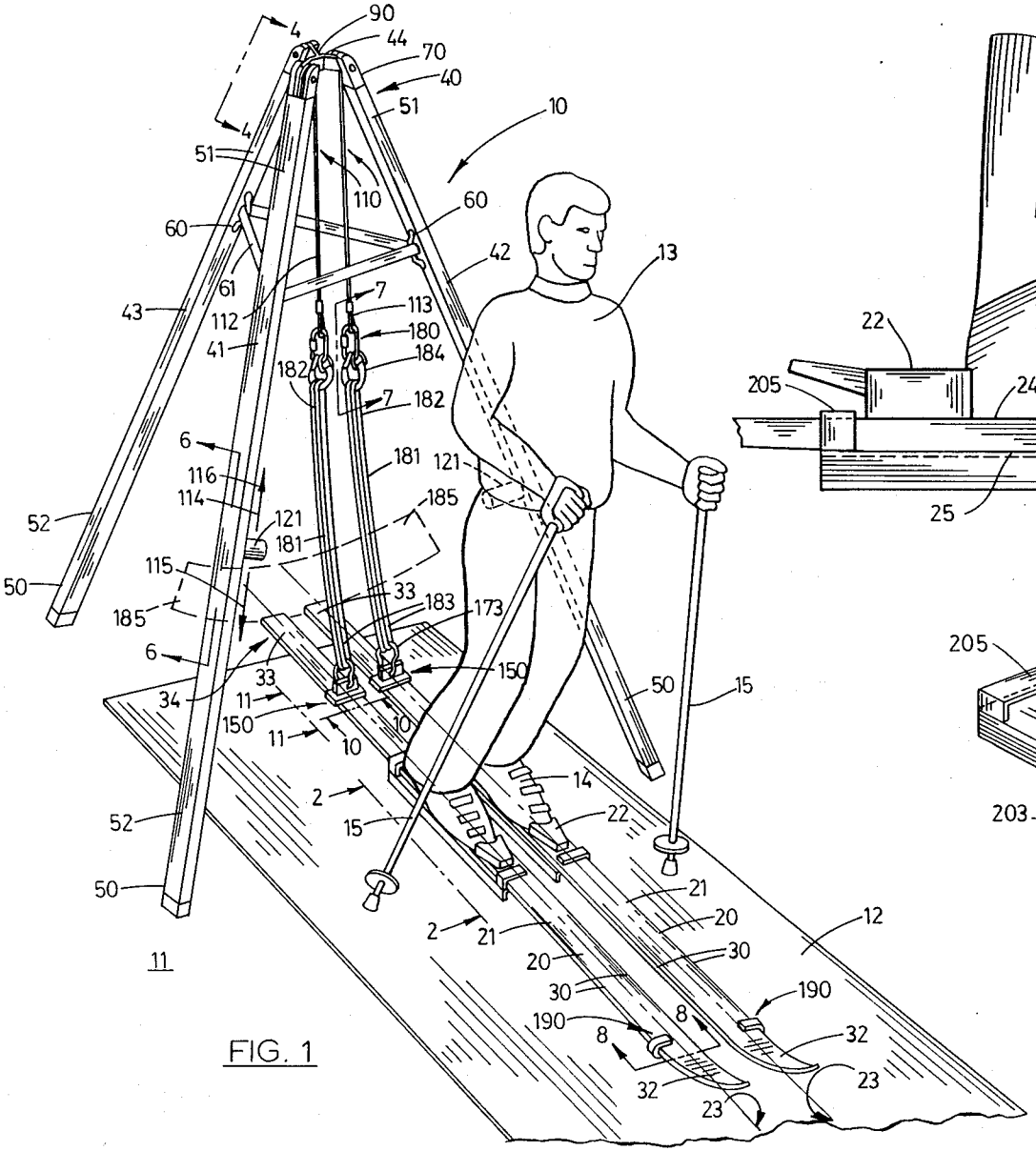
FIG. 1 is a perspective view of the apparatus of the subject invention shown in a typical operative environment.
Figure 8:
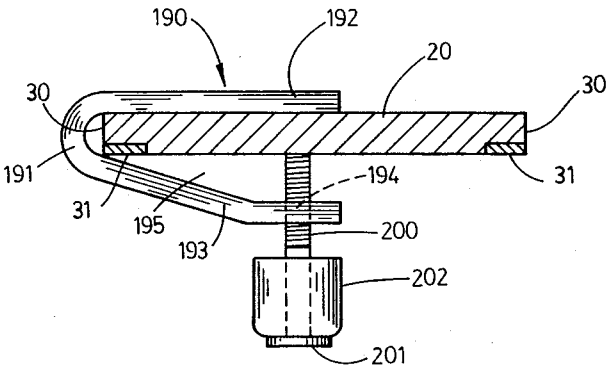
FIG. 8 is a somewhat enlarged transverse sectional view of the apparatus of the subject invention taken from a position along line 8—8 of FIG. 1.
Figure 9:
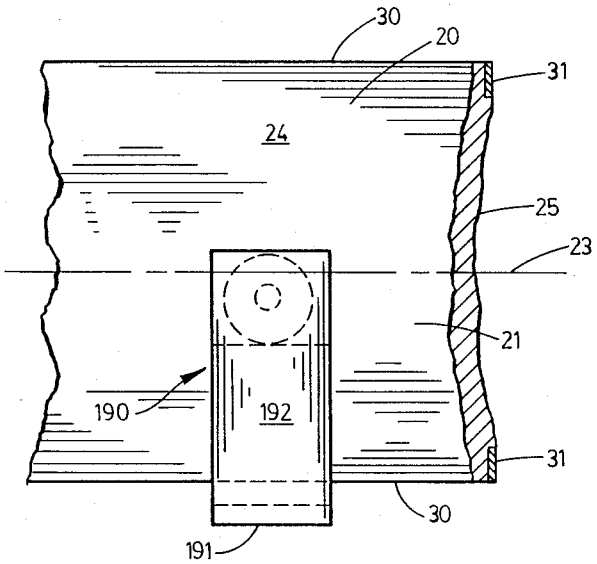
FIG. 9 is a fragmentary top plan view of the apparatus of the subject invention.

Referring more particularly to the drawings, the apparatus for training skiers embodying the principles of the present invention is generally indicated by the numeral 10 in FIG. 1. For illustrative convenience, the apparatus 10, as shown and described herein, is depicted in a typical operative environment wherein it is placed on a supporting surface, such as the surface of the earth 11, and disposed in partial overlaying relation with respect to a pad which is generally indicated by the numeral 12. The pad can be of any suitable wear resistant material such as indoor/outdoor carpeting, or the like. The pad is operable to permit the user thereof to employ the apparatus on any indoor or outdoor surface, and is adapted to protect the bottom of each ski and the underlying supporting surface from damage. The skier, which is generally indicated by the numeral 13, wears a pair of ski boots 14 and holds a ski pole 15 in each hand. Each ski boot is releasably affixed to a ski 20. Each ski is of traditional design having a main body 21 which mounts a binding 22, and which engages the ski boot. Each ski further has a longitudinal axis generally indicated by the line labeled 23, a top surface 24, a bottom surface 25, and a peripheral edge, generally indicated by the numeral 30. As seen most clearly by reference to FIGS. 8 and 9, the peripheral edge mounts a sharpened edge 31 which is operable to engage the snow surface, not shown, the edges causing each ski to turn. Each ski further has a forward portion or tip 32 and a rearward portion or tail 33. As best seen by reference to FIG. 1, the apparatus 10 is adapted to mount each ski in angulated, spaced, resting relation on the surface of the earth. More particularly, a space 34 is formed between the bottom surface 25, which is located at the taii 33 of each ski, and the surface of the earth 11, the space 34 permitting each ski to be moved longitudinally, horizontally, vertically and rotationally about their respective longitudinal axes 23 thereby enabling the skier to simulate assorted ski turns in a highly accurate and repetitive fashion.

A frame, which is generally indicated by the numeral 40, is adapted to support each ski 20 for independent movement about its respective longitudinal axis 23. The frame, which is operable to support each ski in angulated spaced rested relation on the surface of the earth 11 is herein shown in FIG. 1 as a tripod, the tripod having first, second and third frame members, 41, 42, and 43, respectively. The tripod, which was selected for its exceptional stability, has an apex generally indicated by the numeral 44. As best seen by reference to FIG. 6, each of the frame members has a substantially square cross-sectional dimension and further have a proximal or earth engagement end 50 and an opposed distal end 51. Each of the frame members has an exterior surface 52 and an interior surface 53 which defines a longitudinally disposed passageway 54. As best illustrated by reference to FIG. 12, a pair of longitudinally disposed channels 55 individually are formed in the first and second frame member 41 and 42, respectively. Further, indicia, herein illustrated as a plurality of lines, 56 are painted on, or otherwise formed into the exterior surface 52 in predetermined substantially equally spaced positions along the longitudinally disposed channel to aid the skier in positioning the adjustment assembly in selected attitudes along the longitudinal channel 55. The adjustment assembly will hereinafter be discussed in greater detail. In an alternative form of the apparatus which is best illustrated by reference to FIG. 14, a plurality of orifices 57 are formed in predetermined positions along the first and second frame members. As should be understood, the plurality of orifices 57, and the longitudinally disposed channels 55, individually communicate with the longitudinally disposed passageways 54 that are defined by the interior surfaces 53. As best seen by reference to FIG. 1, three metal loops are individually mounted on the first, second and third frame members 41, 42 and 43, respectively, and disposed in close proximity to the distal end 51 thereof. A flexible, yet substantially stretch resistant strap 61 is received through the several metal loops 60 thereby providing a means by which the first, second and third frame members are positioned in fixed substantially equidistantly spaced relation one to the other. As should be understood, the strap permits the apparatus 10, and more specifically the frame 40 thereof to be folded into a compact configuration for convenient storage.

Figure 5:
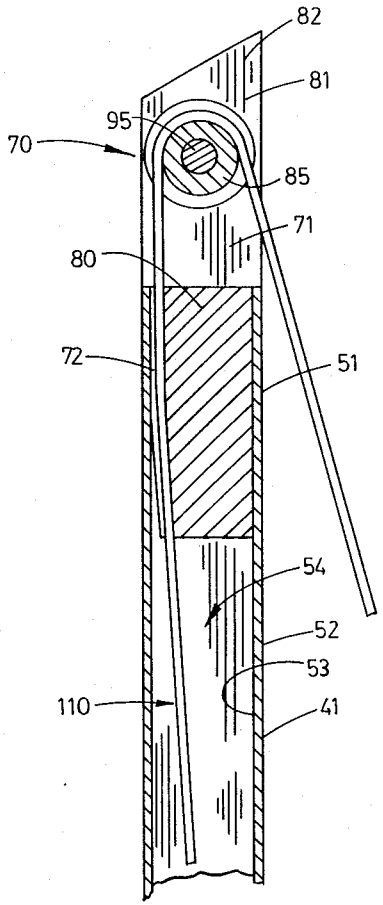
FIG. 5 is a partial longitudinal sectional view of the apparatus of the subject invention taken along line 5—5 of FIG. 4.
Figure 4:
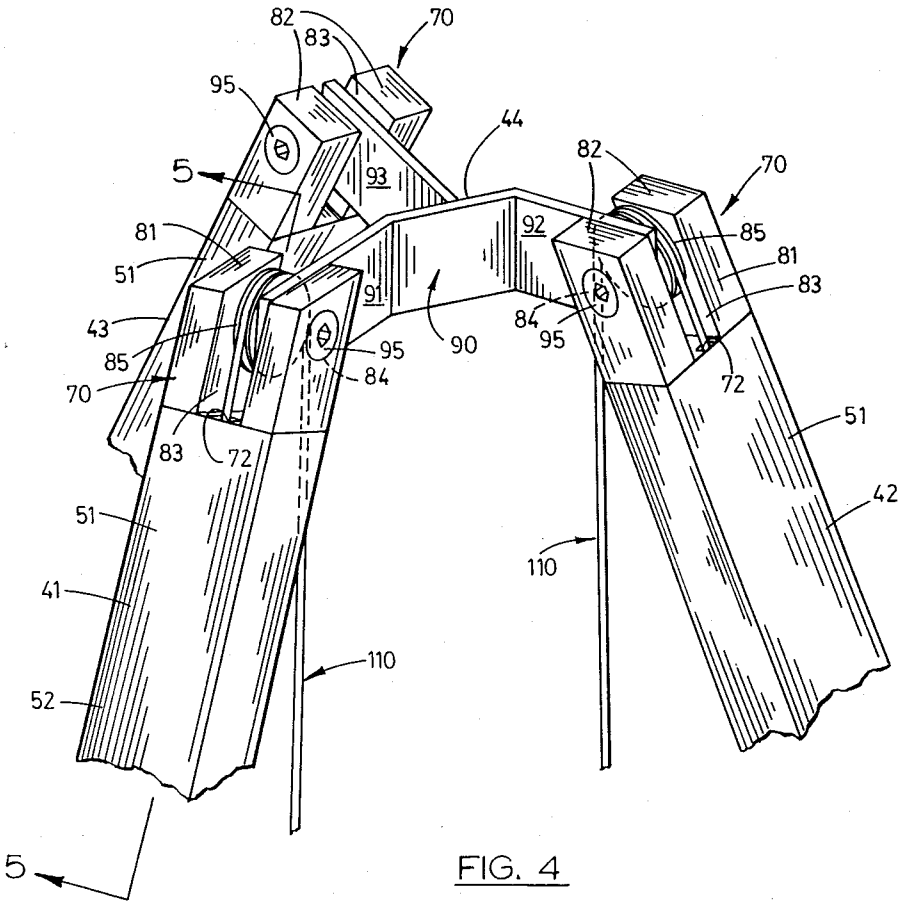
FIG. 4 is a fragmentary, perspective view of the apparatus of the present invention taken from a position along line 4—4 of FIG. 1.

A mounting plug which is generally indicated by the numeral 70 is individually mounted on the distal end 51 of the first, second and third frame members 41, 42 and 43, respectively. The mounting plug, which may be manufactured from a high strength, synthetic, polymer-like material, has a main body 71 that has formed therein a generally longitudinally disposed channel 72 which is positioned in substantial registry and in communication with the longitudinally disposed passageway 54. The mounting plug has a first portion 80 which is formed into a substantially rectangular shape and which is adapted slidably to be received in the longitudinally disposed passageway 54. The main body 71 further has a second portion 81 which defines a pair of legs 82. As best seen by reference to FIGS. 4 and 5, a pair of substantially coaxially aligned orifices are individually formed in each of the legs 82 and are operable to receive a bolt which will hereinafter be discussed in greater detail. The legs further define a channel 83 therebetween. The mounting plugs disposed on the end of the first and second frame members individually mount a pulley 85. The pulleys are individually rotatably mounted in a fixed attitude between the legs by the bolt. This is best illustrated by reference to FIGS. 4 and 5.

An angulated substantially Y-shaped apex member 90 is positioned at the apex 44, of the frame 40, and is disposed in individual sliding mating receipt in each of the channels 83 that are individually formed or otherwise defined by the individual legs 82 of the mounting plug 70. The apex member 90 has first, second and third arms 91, 92 and 93, respectively. Each arm has an orifice (not shown) formed therein, which, when received in the individual channels 80, is disposed in substantial registry and in coaxial alignment with the pair of coaxial aligned orifices 84 which are individually formed in each of the legs 82. A bolt 95 is received in the orifices which are so aligned, and through the pulley, 85 and a wing nut or other fastening device (not shown) is screw-threadably affixed to the bolt. The bolt and the fastening device are individually operable to secure the apex member 90 on the distal ends 51 of the first, second, and third frame members 41, 42, and 43, respectively, and further is adapted rotatably to mount the individual pulleys 85 in predetermined positions between each pair of legs 82.

Figure 6:
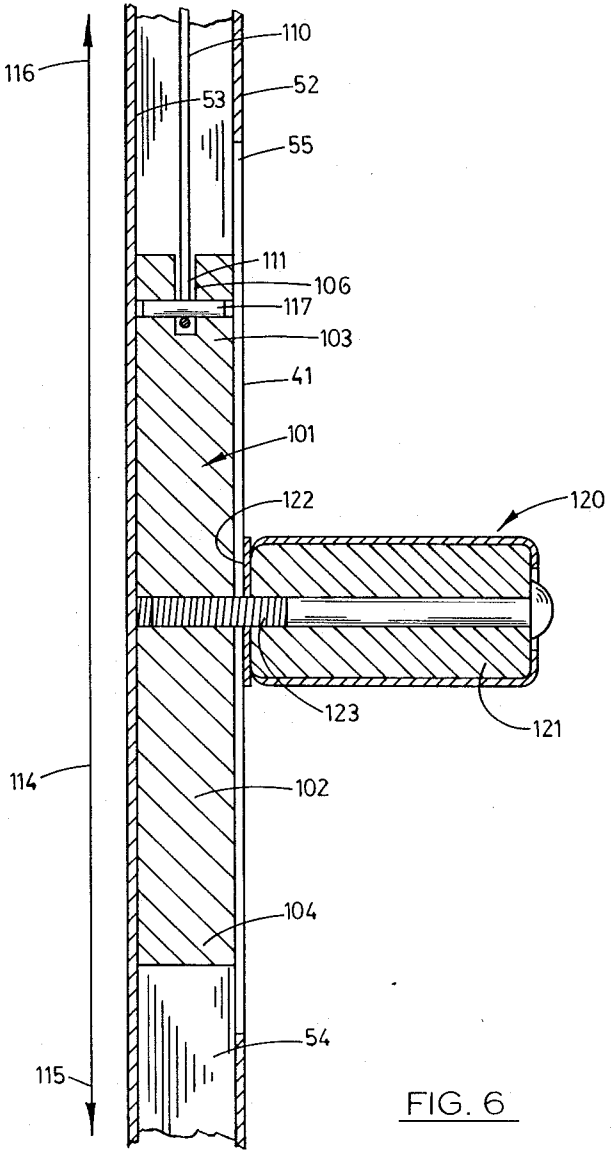
FIG. 6 is a partial longitudinal sectional view taken along line 6—6 of FIG. 1.
Figures 12, 13, 14:
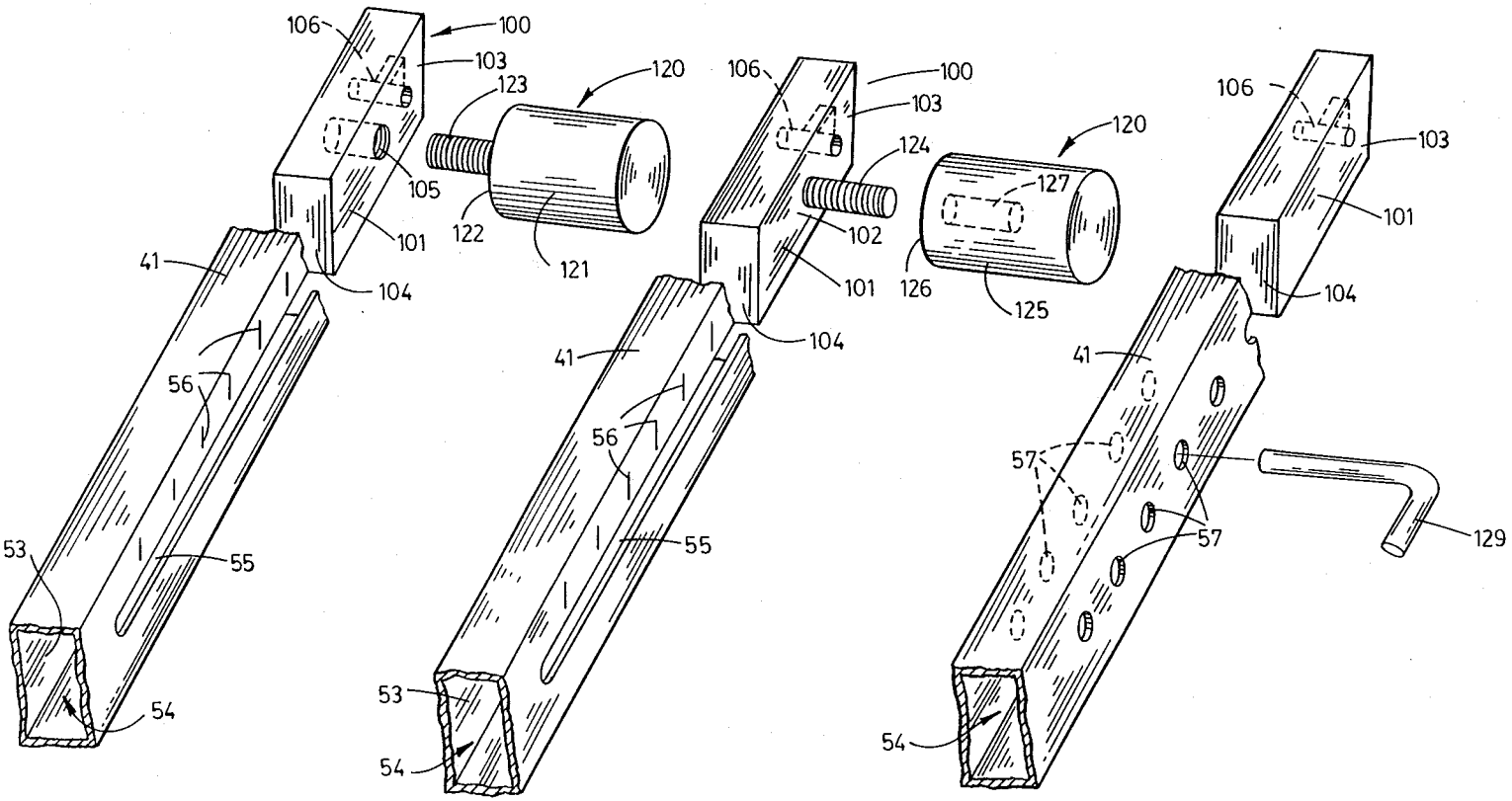
FIG. 12 is an exploded view of the first form of the apparatus of the subject invention taken along line 6—6 of FIG. 1.
FIG. 13 is an exploded view of the second form of the apparatus of the subject invention taken from a position along line 6—6 of FIG. 1.
FIG. 14 is an exploded view of the third form of the subject invention taken from a position along line 6—6 of FIG. 1.

An adjustment assembly which is generally indicated by the numeral 100 is best seen by reference to FIGS. 6 and 12. The adjustment assembly 100 includes a slidable member, herein illustrated as a block 101, which may be manufactured out of any suitable rigid material such as a high strength, synthetic polymer, or a metal alloy. The block 101 has a main body 102 which is substantially rectangular in shape and which is conformably dimensioned slidably to be received in the longitudinally disposed passageway 54 which is defined by the interior surface 53 of the first, second and third frame members 41, 42 and 43, respectively. The main body 102 has a first end 103 and a second end 104. Further, the main body, in its first embodiment, has a screw-threadably shaped passageway 105 formed therein which is disposed in registry or otherwise in substantially coaxial alignment with the longitudinally disposed channel 55 which is formed in the exterior surface 52 of the first and second frame members 41 and 42, respectively. Further a T-shaped channel 106 is formed in the first end 103 of the main body 101. This is best illustrated by reference to FIG. 6.

As best seen by reference to FIGS. 1 and 6, a pair of cables which are generally indicated by the numeral 110 have individual proximal and distal ends 111 and 112, respectively. The proximal ends of the cables are individually mounted on the first end 103 of the main body 102 by a pin 117 which is slidably received in the T-shaped channel 106, and the distal ends 112 extend downwardly from a location on the frame 40 in close proximity to the apex 44. As best illustrated by reference to FIG. 5, each cable 110 is slidably received through the individual channels 72 that are formed in the main body 71 of the mounting plugs 70. The distal ends of the cables have a loop 113 formed therein and the adjustment assembly 100 is operable selectively to be positioned in predetermined positions along the longitudinally disposed passageway 54 so as to adjust the individual cables, as to length, relative to the apex. A securing device, which is generally indicated by the numeral 120 selectively is operable to position the adjustment assembly 100 in selected locations therealong the longitudinally disposed passageway 54.

As illustrated most clearly by reference to FIG. 6 and 12, the securing device, in its first form, includes a handle 121 which is substantially cylindrical in shape and which defines a shoulder portion 122. Further, the handle 121 mounts a threaded shaft which is generally indicated by the numeral 123. The threaded shaft is conformably dimensioned for screw-threadable mating receipt in the screw-threadably shaped passageway 105 that is formed in the main body 102 of the slidable member 101. As best imagined by a study of FIG. 12, the handles are individually operable selectively to impart clockwise and counterclockwise rotational motion to the individual threaded shafts about their respective longitudinal axes, the handles operable upon clockwise rotational movement to cause the shoulder portions of the individual handles to engage the respective frame members thereby inhibiting movement of the slidable members along the passageway, and upon counterclockwise rotational movement to disengage from the respective frame members thereby permitting movement of the slidable members along the passageway 54. As earlier discussed, the securing devices 120 are individually operable to position the slidable members in selected locations along the longitudinally disposed passageways 54 for purposes of adjusting the individual cables as to length relative to the apex. The slidable members 101 are movable along a path of movement 114 between a first position 115 and a second position 116. This is shown most clearly by reference to FIG. 1.

Figure 10:
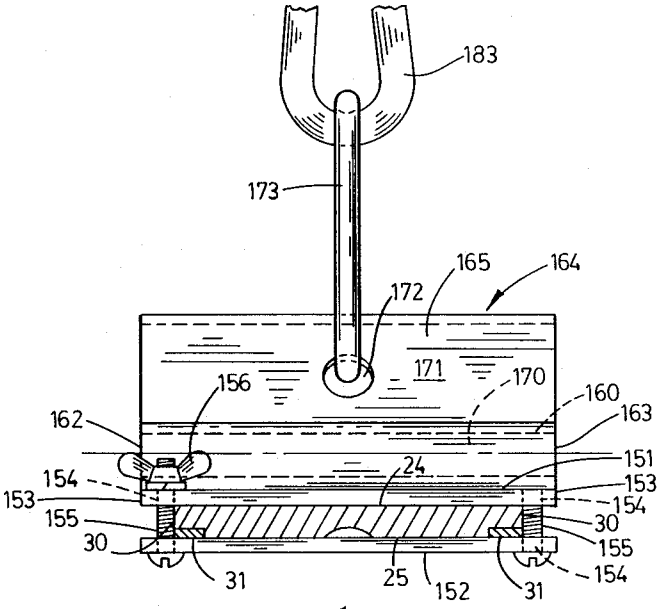
FIG. 10 is a somewhat enlarged partial side elevation of the apparatus of the subject invention taken from a position along line 10—10 of FIG. 1.
Figure 11:
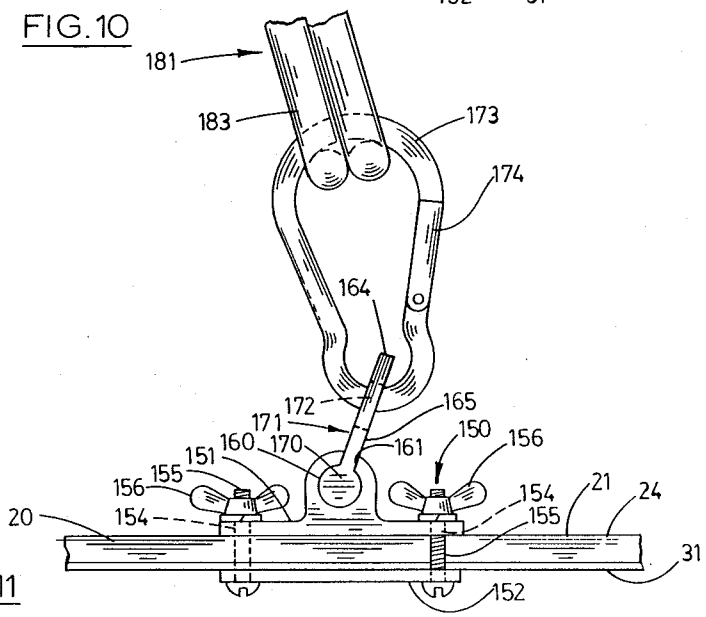
FIG. 11 is a somewhat enlarged, partial, side elevation of the apparatus of the subject invention taken from a position along line 11—11 of FIG. 1.

As best seen by reference to FIGS. 1 and 10, a support frame, which is generally indicated by the numeral 150 is mounted in close proximity to the tail or rearward portion 33 of each ski 20. The support frame includes a top plate 151 and a bottom plate 152. Each plate 151 and 152 has a peripheral edge 153 which individually extends beyond the peripheral edge 30 of each ski.

Formed into the peripheral edge of the top and bottom plate 151 and 152, respectively, is a pair of bolt receiving stations 154. The bolt receiving stations formed in the top and bottom plates are disposed in the opposite corners as best seen by reference to FIG. 10. The pair of bolt receiving stations further are substantially coaxially aligned, one with the other, thereby permitting a pair of bolts 155 to be individually received in slidable mating relation therein. Wing nuts 156 are screw-threadably affixed to the bolts and operate securely to clamp the top and bottom plates to the main body 21 of each ski 20.

As best seen by reference to FIG. 10, the top plate 151 mounts a discontinuous channel or housing 160 which is disposed substantially transversely of the longitudinal axis 23 of each ski 20. The channel 160 defines a gap or space 161, and further has a first end 162 and a second end 163. As should be understood, the first and second ends of the channel 160 are open, the individual channels adapted to receive a slide plate which is generally indicated by the numeral 164. The slide plate has a main body 165 which mounts a cylindrically shaped first portion 170. The first portions 170 are individually and conformably dimensioned slidably to be received in each channel. Each main body further has a second portion or plate 171 which is affixed to the first portion by welding or the like. The plate 171 has a thickness dimension which permits it slidably to be received in the gap 161. As illustrated most clearly by reference to FIG. 10, an orifice 172 is formed in the plate and is operable to be engaged by a snap link 173 of conventional design. The snap link 173 has a gate 174.

Figure 7:
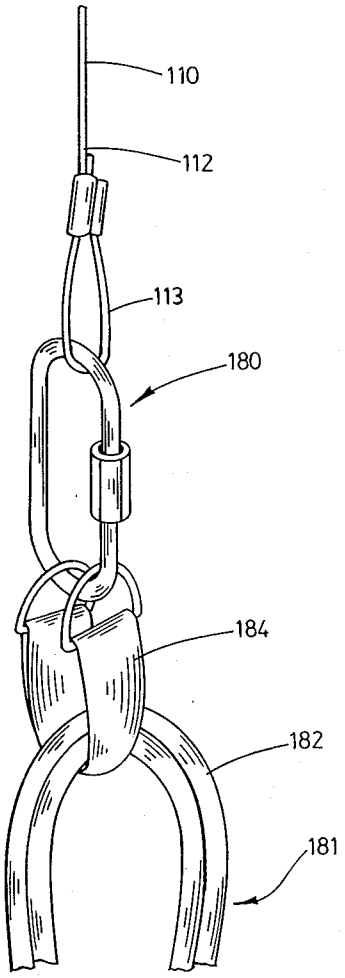
FIG. 7 is a somewhat enlarged partial perspective view of the apparatus of the subject invention taken from a position along line 7—7 of FIG. 1.

As best seen by reference to FIGS. 1 and 7, a pair of snap links 180, of conventional design, are individually affixed on each of the loops 113 which are formed on the distal ends 112 of each of the cables 110. A pair of resilient cords 181 are individually mounted on each of the snap links 180. The pair of resilient cords each have a first end 182 and a second end 183. As illustrated most clearly by reference to FIG. 7, a pair of connector loops, which are generally indicated by the numeral 184 individually mount the first ends of each resilient cord to the individual snap links 180. The overall length and cross-sectional dimension of each resilient cord is such that the resilient cords, acting in combination, impart a frequency of motion to each ski tail 33 which closely approximates the rate of turning necessary for a skier to maintain effective control on an advanced or intermediate slope, not shown. As best imagined by a study of FIG. 1, the pair of resilient cords permits the individual ski tails to move independently of each other within a zone of travel 185; each ski 20 being permitted to move horizontally, vertically, and rotationally about its respective longitudinal axis 23, thereby permitting the skier 13 to simulate various ski turns on a repetitive basis in order to develop a correct sense of timing, balance and rhythm. Further, the adjustment assembly 100 is adapted to position the individual resilient cords in predetermined attitudes relative to the apex 44 so that they may effectively counterbalance the skier's body weight. This is accomplished by individually positioning each of the adjustment assemblies in various positions along the longitudinally disposed passageways 54 and securing it in those positions by employing the securing devices 120.

A pair of pivot assemblies or forward supports 190 are individually mounted in close proximity to the tip 30 of each ski 20. Each pivot assembly 190 has a unitary main body 191 which includes a top portion 192 and a bottom portion 193. A threaded orifice 194 is formed in the bottom portion 193, and the top and bottom portions define a channel 195 which is adapted to receive the main body 21 of each ski 20. As best seen by reference to FIG. 8, a threaded post 200 is screw-threadably received in the threaded orifice 194, the threaded post further has a head 201. A grip 202 is affixed to the head 201 and is operable to impart rotational movement to the threaded post so as to capture the main body 21 of each ski 20 in the channel 195 formed between the top and bottom portions 192 and 193, respectively. As best seen by reference to FIG. 9, the threaded post is disposed substantially centrally of the bottom surface 25 and in substantial alignment with the longitudinal axis 23 of each ski 20. As best imagined by a study of FIG. 1, as each of the tails 33, of the individual skis, is cyclically swung and rotated in the zone of travel 185, the individual pivot assemblies 190 permits the main body 21 of each ski to be shifted such that a skier can simulate the body and ski positions necessary to effectuate the edging which will accomplish the desired ski turn. As earlier discussed, by utilizing the adjustment assemblies, the length of each of the cables relative to the apex, can be adjusted so as to position each of the resilient cords in an attitude which will permit them to counterbalance the skier's body weight. This of course permits the apparatus to be adjusted and utilized by skiers having widely varying body weights.

Figure 2:
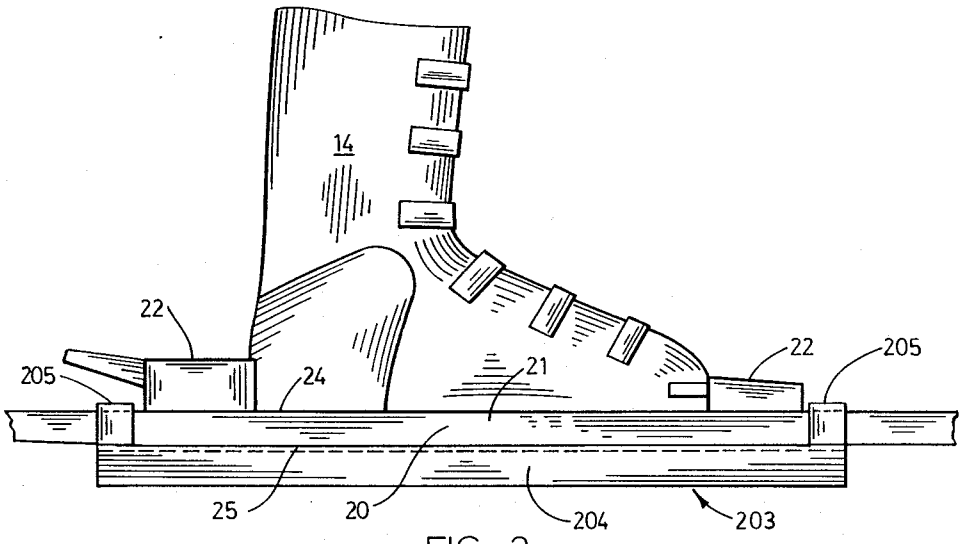
FIG. 2 is a somewhat enlarged, fragmentary, side elevation of the subject invention taken from a position along line 2—2 of FIG. 1.
Figure 3:
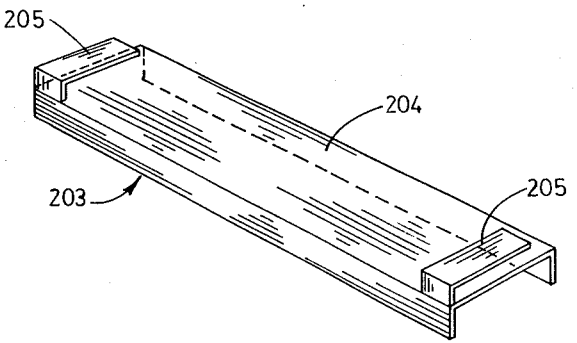
FIG. 3 is a perspective view of one of the shielding devices of the subject invention.

As best illustrated by reference to FIGS. 1, 2 and 3, each ski mounts a guard or shielding assembly 203 which is operable to protect the bottom surface 25 of each ski 20 from damage occasioned by contact with the surface of the earth 11. The shielding assemblies each have a main body 204 which has a length dimension that is less than the length of the ski and a width dimension which is substantially equal to the width dimension of the individual skis. Further, a pair of attachment members 205 is operable releasably to secure the main body to the bottom surface of each ski.

Second Form

The second form of the subject invention is best seen by reference to FIG. 13. As shown therein, the apparatus 10 is substantially identical to the first form except as noted hereinafter. The adjustment assembly 100 of the second form of the invention has a slidable member 101. However, the slidable member, in contrast to the first form of the invention, would not have a screw-threadably shaped passageway 105 formed therein, rather, the slidable member would mount a threaded shaft 124 which would be disposed in substantially slidable receipt in the longitudinally disposed channel 55. Further, a handle 125 is operable matingly to engage the threaded shaft. The handle has a shoulder area 126 and further has a screw-threadably shaped channel 127 formed therein. The channel 127 permits the handle screw-threadably to mate with the threaded shaft 124. As earlier discussed with respect to the first form the invention, and upon clockwise rotation of the handle, the shoulder portion thereof would engage the individual frame members 41 and 42 thereby inhibiting movement of the slidable member along the passageway 54. Further, counterclockwise rotation of the handle 125 would release the slidable member for movement along the longitudinally disposed passageway 54 thereby permitting the individual adjustment of the resilient cords 181 in such a fashion so as to counterbalance the skier's body weight.

Third Form

The third form of the apparatus is best illustrated by reference to FIG. 14. As shown therein, the first and second frame members 41 and 42, respectively, have formed therein a plurality of spaced substantially coaxially aligned orifices 57. Further the securing means includes a locking pin which is generally indicated by the numeral 129. The locking pin is slidably received in the coaxially aligned orifices and is thereby positioned in occluding relation to the longitudinally disposed passageway 54. In such a position, the pin is operable to inhibit movement of the slidable member 101 along the passageway thereby causing the slidable member to be located at predetermined positions along the longitudinally disposed passageway.

OPERATION

First, Second and Third Forms

The operation of the described embodiments of the present invention is believed to be readily apparent and is briefly summarized at this point.

Each ski 20 is worn by a skier 13 in the conventional manner, that is, the skier wears a pair of ski boots 14 that are releasably engaged by the ski bindings 22 which are mounted on each ski.

As best seen by reference to FIG. 1, each support frame 150 is individually mounted in close proximity to the tail or rearward portion 33 of each ski 20. Each support frame is interconnected to the frame 40 by a resilient cord 181 which are individually operable to suspend each ski in angulated, spaced, rested relation on the surface of the earth 11 thereby permitting the tails of each ski to be moved variously in the zone of travel 185 such that the skier can simulate various ski turns. As earlier discussed, the lengths, and cross-sectional dimensions of the individual resilient cords 131 are selected such that the resilient cords, acting in combination, will impart a natural frequency of motion to the individual ski tails which closely simulates a selected ski turn on an advanced to intermediate ski slope. Similarly, it should be understood that the cyclical swinging and rotation of each ski 20 about its respective longitudinal axis 23 permits the skier 13 closely to approach the basic body actions of weighting and unweighting each ski and the edging actions necessary to perform most types of ski maneuvers.

The apparatus 1 allows the repetition of ski turns thereby permitting the development of improved rhythm, balance, timing, and the aerobic conditioning required to improve the overall ski technique. In the event the skier becomes unbalanced and falls off the skis 20, the slide plate 164 is operable to disengage from the support frame 150 by sliding out of mating engagement with the channel 160. The pivot assemblies 190 further are operable to permit the main body of each ski to rotate about its respective longitudinal axis thereby permitting the accurate reproduction of a simulated ski turn. Moreover, the individual adjustment assemblies 100 are operable selectively to be positioned in predetermined locations therealong the longitudinally disposed passageway 54 for purposes of adjusting, as to length, the distal end 112 of the cable 110 in relation to the apex 44. By adjusting he cable as to length, the skier can position the individual resilient cords in predetermined attitudes such that they can, in combination, effectively counterbalance the skier's body weight thereby permitting the apparatus to be utilized by skiers having widely varying body weights, and skiing abilities.

Therefore, the apparatus for training skiers for downhill skiing of the present invention provides a new and novel means by which a skier can practice simulated ski turns for purposes of improving their overall skiing technique. The invention is operable to exercise the various muscle groups which are primarily involved in performing various ski turns and is adapted to improve the skiers' overall performance by permitting the skiers to utilize their own equipment. Furthermore, the apparatus allows the skier to develop a correct sense of balance, rhythm and timing through repetition of the various turns. Finally, the repeated use of the apparatus improves the skier's aerobic conditioning which is necessary for extended ski runs.

Although the invention has been herein shown and described in what are conceived to be the most practical and preferred embodiments, it is recognized that departures may be made therefrom within the scope of the invention which is not to be limited to the illustrative details disclosed.

Having described my invention, what I claim as new and desire to secure by Letters Patent is:

1. An apparatus for training a skier wearing a pair of skis, the apparatus comprising:

a support structure adapted to be disposed on a supporting surface in upright relation, said support structure having at least three legs terminating in an apex and at least one of said legs having an internal passageway;

an adjustment assembly mounted on the support structure for positioning the rearward portions of the skis in elevated spaced relation above the supporting surface while the skier is wearing the skis, the adjustment assembly including a member slidably received in the passageway and adapted for movement therein, a cable having proximal and distal ends mounted on the member at said proximal end, the distal end of the cable extending downwardly from a position in close proximity to the apex, and means mounted on the support structure for securing the member in preselected positions along the passageway for adjusting the cable as to length relative to said apex;

means mounted on the rearward portions of the skis and attached to the adjustment assembly for resiliently mounting the rearward portions of the skis on the adjustment assembly; and a forward support assembly mounted on the forward portion of each ski and disposed in rested relation on the supporting surface and in supporting relation to said forward portion of the ski including means for permitting independent pivotal and translational movement of the forward portion of each ski to permit the skier wearing said skis to simulate skiing maneuvers.

2. The apparatus of claim 1 wherein the securing means includes an orifice formed in a predetermined position along the frame member and communicating with the passageway, and a pin is slidably received in the orifice and is thereby positioned in occluding relation to the passageway, the pin operable to inhibit movement of the member along the passageway.

3. The apparatus of claim 1 wherein the securing means includes a channel formed in the leg having the passageway extending longitudinally thereof and communicating with said passageway, the member has a screw threaded bore disposed in substantial alignment with said channel, and a handle mounting a screw threaded shaft adapted screw-threadably to be secured in said bore, the handle operable upon clockwise rotation with said shaft to engage the leg thereby preventing movement of the member along the passageway and upon counterclockwise rotation to disengage from the leg thereby permitting movement of the member along the passageway.

4. The apparatus of claim 1 wherein the securing means includes a channel formed in the leg having the passageway extending longitudinally thereof and communicating with said passageway, the member mounts a screw threaded shaft which extends through the channel of the leg and a handle having a screw threaded bore adapted screw-threadably to be secured on the screw threaded shaft, the handle operable upon clockwise rotation to engage the leg thereby preventing movement of the member along the passageway and upon counterclockwise rotation to disengage from the leg thereby permitting movement of the slidable member along the passageway.

5. The apparatus of claim 1 wherein the resilient means includes a pair of support frames individually mounted on the rearward portions of their respective skis and a pair of resilient cords individually interconnect the distal end of the cable and the individual support frames.

6. The apparatus of claim 5 wherein the support frame of each ski has a channel which is substantially cylindrically shaped in cross section disposed substantially transversely of the longitudinal axis of the ski and a plate having a portion slidably received in the channel is operable to release the rearward portion of the ski from said elevated position upon rotation of the ski sufficiently about its respective longitudinal axis to cause said portion of the plate to slide from said channel.

7. The apparatus of claim 6 wherein each forward support assembly has a main body slidably mounted on the forward portion of one of said skis and a post is screw-threadably mounted on the main body thereof in engagement with its respective ski to clamp the main body of the forward support assembly on the forward portion of the ski whereby said post is disposed for rested engagement with said supporting surface to allow pivoting of the ski about its respective longitudinal axis.

8. The apparatus of claim 7 wherein each ski has a bottom surface and a shielding assembly is releasably mounted on each ski having an elongated main body with a length dimension which is shorter than the length of the ski and a width dimension substantially equal to the width of the ski for protection of the bottom surface of the ski.

9. An apparatus for training skiers adapted for use with a pair of skis, each ski having a main body having a tip, a tail and a longitudinal axis, the apparatus comprising:

a support structure disposed in rested relation on a supporting surface, the support structure having at least three legs terminating in an apex and at least one of said legs having an internal passageway formed therein;

an adjustment assembly slidably received in the passageway and adapted to be releasably mounted in selected positions along the passageway;

a cable mounted on the adjustment assembly and adjusted as to length relative to the support structure by the adjustment assembly;

a support frame releasably mounted on the tail of each ski and having a channel disposed substantially transversely of the longitudinal axis of the ski and a slide plate, having an orifice, slidably mounted in said channel, said slide plates individually operable to release their respective skis from the apparatus upon rotation of the individual skis sufficiently about their respective longitudinal axes to cause the individual plates to slide from said channels;

a pair of resilient cords, having opposite ends, individually attached at one end to one of the slide plates using the orifice thereof and attached at the other of its ends to the cable thereby supporting the tails of the skis in spaced relation to the surface of the earth and said adjustment assembly is operable to position the individual resilient cords relative to the support structure to counterbalance the skiers body weight thereby positioning the skier in spaced relation to the supporting surface; and a forward support assembly mounted in proximity to the tip of each ski and having a main body which is dimensioned slidably to be received on the main body of the ski and a post is screw-threadably mounted on the main body of the forward support assembly operable to position the tip of its respective ski in spaced relation to said supporting surface permitting the skier independently to move the skis along the support surface and about their respective longitudinal axes for simulating ski maneuvers.

10. The apparatus of claim 11 wherein said channel of each support frame has a gap and the slide plate thereof has a main body with a cylindrical portion and a plate, the cylindrical portion dimensioned slidably to be received in the channel, said plate has said orifice formed therein, is mounted on said cylindrical portion and extends through the gap whereby the slide plates are individually adapted to slide out of their respective channels thereby releasing the individual skis from the apparatus when the skis are sufficiently rotated about their respective longitudinal axes to cause said plates to slide from said channels.

11. The apparatus of claim 10 wherein each post is disposed substantially centrally of the main body of its respective ski and in substantial alignment with the longitudinal axis of the ski and each of the resilient cords has a length and cross-sectional dimension which imparts a frequency of motion to the tail of each ski which closely approximates the rate of turning necessary to allow the skier to maintain effective control on an intermediate to advanced ski slope.

12. The apparatus of claim 11 including means mounted on the support structure for securing the adjustment assembly in predetermined positions along the passageway.

13. An apparatus for training skiers and adapted for use with a pair of skis, each ski having a main body with a tip, a tail and a longitudinal axis, the apparatus comprising:

a support structure disposed in rested relation on a supporting surface, the support structure having a frame member with an internal passageway formed therein;

an adjustment assembly slidably received in the passageway and adapted to be releasably mounted in selected positions along the passageway;

a cable mounted on the adjustment assembly and adjusted as to length relative to the support structure by the adjustment assembly;

a support frame releasably mounted on the tail of each ski and having a channel disposed substantially transversely of the longitudinal axis of the ski and a slide plate, having an orifice, slidably mounted in said channel, said slide plates individually operable to release their respective skis from support by said support structure upon rotation of the individual skis sufficiently about their respective longitudinal axes to cause their respective slide plates to slide from their respective channels;

a pair of resilient cords individually mounted on the slide plates using the orifice thereof and at corresponding opposite ends on said cable individually to mount the tails of the skis in spaced relation to the surface of the earth whereby the adjustment assembly is operable to position the individual resilient cords in predetermined positions relative to the support structure substantially to counterbalance said skier's body weight thereby positioning the skier in spaced relation to the supporting surface;

a forward support assembly mounted in proximity to the tip of each ski and extending therefrom for engagement with said supporting surface to support the tip of its respective ski in spaced relation to said supporting surface permitting said skier independently to move each ski about its respective longitudinal axis simulating skiing maneuvers; and means mounted on said support structure for securing the adjustment assembly in predetermined positions along the passageway including an orifice formed in a predetermined position in the frame member and communicating with the passageway and a pin slidably received in the orifice and thereby positioned in occluding relation to the passageway to prevent movement of the slidable member along the passageway.

14. The apparatus of claim 13 wherein the securing means includes a channel formed in the leg communicating with the passageway, the slidable member has a screw threaded bore disposed in substantial alignment with the channel and a handle mounting a screw threaded shaft is adapted to be screw-threadably secured in said screw threaded bore and adapted upon clockwise rotation to engage the leg thereby preventing movement of the slidable member along the passageway and upon counterclockwise rotation to disengage from the leg thereby permitting movement of the slidable member along the passageway.

15. The apparatus of claim 13 wherein the securing means includes a channel formed in the leg communicating with the passageway the member mounts a screw threaded shaft which extends through the channel, and a handle is adapted screw-threadably to mate with the screw threaded shaft whereby the handle is operable upon clockwise rotation to engage the leg to prevent movement of the slidable member along the passageway and upon counterclockwise rotation to disengage from the leg thereby permitting movement of the slidable member along the passageway.

* * * * *

UNITED STATES PATENT AND TRADEMARK OFFICE

CERTIFICATE OF CORRECTION

PATENT NO. : 4,909,503

DATED : March 20, 1990

INVENTOR(S) : Bruce R. Olson

It is certified that error appears in the above-identified patent and that said Letters Patent is hereby corrected as shown below:

Col. 9, line 50, delete "1", and insert --10--

Col. 12, line 38, delete "11" and insert --9--

Signed and Sealed this

Twenty-first Day of May, 1991

*Attest:*

HARRY F. MANBECK, JR.

*Attesting Officer*

*Commissioner of Patents and Trademarks*